US006000992A

United States Patent [19]

Lambert

[11] Patent Number: 6,000,992

[45] Date of Patent: Dec. 14, 1999

[54] TOY VEHICLE TRACKSET HAVING RAPID-FIRE LAUNCHER

[75] Inventor: Gérard L. Lambert, Torrance, Calif.

[73] Assignee: Mattel, Inc., El Segundo, Calif.

[21] Appl. No.: 09/133,906

[22] Filed: Aug. 13, 1998

[51] Int. Cl.[6] ..... A63H 18/00

[52] U.S. Cl. ..... 446/430; 446/444

[58] Field of Search ..... 446/6, 429, 430, 446/444; 473/58, 64; 273/121 D, 129 R, 129 Q

[56] References Cited

U.S. PATENT DOCUMENTS

| | | | |
|---|---|---|---|
| 3,674,269 | 7/1972 | Cooper et al | 463/58 |
| 3,696,555 | 10/1972 | Bales et al. | 446/430 |
| 3,717,346 | 2/1973 | Merino et al. | 446/429 |
| 3,797,164 | 3/1974 | Glass et al. | 446/429 |
| 3,814,021 | 6/1974 | McHenry | 446/444 |
| 3,908,303 | 9/1975 | McKay et al. | 446/430 |
| 4,146,991 | 4/1979 | Sano . | |
| 4,267,661 | 5/1981 | Hanson . | |
| 4,475,303 | 10/1984 | Ribas et al. | 446/429 |
| 4,564,197 | 1/1986 | Lambert et al. | 446/430 |
| 4,605,230 | 8/1986 | Halford et al. | 446/429 |
| 4,642,066 | 2/1987 | Kennedy et al. | 446/420 |
| 4,925,188 | 5/1990 | McKay et al. | 463/64 |
| 5,254,030 | 10/1993 | Ostendorff et al. | 446/430 |
| 5,586,923 | 12/1996 | Hippely et al. | 446/14 |

FOREIGN PATENT DOCUMENTS

| | | | |
|---|---|---|---|
| 2060415 | 5/1981 | United Kingdom | 446/429 |

*Primary Examiner*—Robert A. Hafer
*Assistant Examiner*—Jeffrey D. Carlson
*Attorney, Agent, or Firm*—Roy A. Ekstrand

[57] ABSTRACT

A toy vehicle launcher includes a launching station together with an aligned spring-driven striker shuttle for launching toy vehicles from the launcher. The launcher further includes a vehicle magazine having an inclined ramp for storing vehicles and sequentially feeding the lowest vehicle to the launcher station as a preceding vehicle is launched. A trackway is coupled to the launcher and includes an intersection having a straight-through path and an angled return path. The trackway includes a curve to guide toy vehicles from the straight-through path to the angled path. Simultaneous entry of toy vehicles on the straight-through path and the angled path result in a dramatic collision.

6 Claims, 2 Drawing Sheets

TOY VEHICLE TRACKSET HAVING RAPID-FIRE LAUNCHER

FIELD OF THE INVENTION

This invention relates generally to toy vehicle tracksets and particularly to those utilizing a vehicle launching mechanism.

BACKGROUND OF THE INVENTION

Toy vehicle tracksets are well known and are well established in the art and are provided in a wide variety of designs and function. The track portion of most current tracksets utilizes trackways formed of extended lengths of molded plastic flexible track portions and interlocking or cooperating connectors allowing the track portions to be formed into the desired shape of track. Others, however, still utilize relatively rigid track structures such as trackways formed of wood or paper based materials as well as large scale molded plastic trackways. In some trackways, a plurality of electrical conductors are situated upon the track and are coupled to a source of operative power. In such toy vehicle tracksets, the toy vehicles utilized employ power pickup contacts and an onboard motor and drive mechanism. In one such toy vehicle trackset, the conductors are supported within a center slot running the length of the trackway. Such tracksets have been known generally as "slot cars". Still other toy vehicle tracksets utilize vehicles having an internal battery power source together with an electric motor to provide propulsion.

Despite the progress in various types of powered toy vehicles for tracksets, the majority of such tracksets still utilize unpowered free-wheeling cars. The method of propulsion for free-wheeling unpowered cars with tracksets is subject to substantial variety. Probably the simplest propulsion is found in a trackset ramp which utilizes gravity and a severe slope in the trackset to launch the vehicles from a higher position to a lower position. Still other toy vehicle tracksets utilize spring-driven launchers often employing a moving ram which is spring-powered and which fires a toy vehicle from a launch position by impact. Still others utilize a speed booster or accelerator within the trackway. Such boosters are usually provided by a pair of soft resilient disk-like wheels placed on opposed sides of a trackway portion which are rotated at high speed to engage the vehicle passing therethrough and impart additional energy to the vehicle.

For example, U.S. Pat. No. 2,524,030 issued to Ostendorff, et al. sets forth a RAPID ACTION TOY VEHICLE LAUNCHER having a generally planar base supporting a pair of angularly disposed downwardly sloped feed ramps having a plurality of vehicles thereon. A pivotally supported carriage defines a pair of angularly disposed launching stations for receiving toy vehicles alternately between the feed ramps. A movable spring-loaded striker is operative in response to handle motion to strike the toy vehicle positioned within the launch position and to drive the vehicle outwardly from the launcher.

U.S. Pat. No. 4,146,991 issued to Sano sets forth a TOY TRACKWAY having a pair of side-by-side track portions, one of which utilizes a spring-driven launcher at one end thereof. The side-by-side track portions are coupled by a double vertical loop arranged such that a launched toy vehicle traverses one track portion to enter the double loop and exits the double loop to traverse the remaining track portion in the opposite direction.

U.S. Pat. No. 4,642,066 issued to Kennedy, et al. sets forth a TOY VEHICLE LAUNCHER AND SOUND GENERATOR having a hexagonal magazine rotatably mounted on a frame and having a plurality of pairs of open-ended chambers therein. As the magazine is rotated, toy vehicles are shifted from the magazine to a launch position. A spring-loaded ram is supported in the base and is operative to launch an aligned vehicle.

U.S. Pat. No. 5,586,923 issued to Hippely, et al. sets forth a TOY VEHICLE PLAYSET FOR THERMOCHROMIC VEHICLES having a trackset including a vehicle launcher, a straight track portion, a vertical loop track portion, a water tank and an exit trackway. Toy vehicles having thermochromic finishes thereon are launched from the launcher traversing the track and the loop and passing through the temperature changing water bath and thereafter exiting the trackset.

U.S. Pat. No. 4,267,661 issued to Hanson sets forth a MULTIPLE VEHICLE LAUNCHER having a flower-like rotating magazine positioned above a downwardly sloped trackway. The magazine provides support for a radially positioned plurality of toy vehicles and as the magazine rotates, each toy vehicle is launched down the trackway when it comes into alignment therewith.

While the foregoing described prior art devices have improved the art and in some instances enjoyed commercial success, there remains nonetheless a continuing need in the art for evermore improved amusing and cost efficient toy vehicle tracksets.

SUMMARY OF THE INVENTION

Accordingly, it is a general object to provide an improved toy vehicle trackset. It is a more particular object of the present invention to provide an improved toy vehicle trackset having a rapid fire vehicle launcher. It is a still more particular object of the present invention to provide an improved toy vehicle trackset having a rapid fire vehicle launcher which adds a further amusement activity by utilizing a potentially crash causing intersection in the trackway.

In accordance with the present invention, there is provided a toy vehicle trackset and plurality of toy vehicles in combination comprising: a plurality of toy vehicles; a vehicle launcher having a base, a launch station, a striker shuttle slidably movable upon the base, a spring coupled between the striker shuttle and the base, a toy vehicle magazine having a ramp angled downwardly toward the launch station; an intersection having a pair of straight-through track supports and an acutely angled track support; a first track segment coupled between the base and one of the straight-through track supports; a second track coupled between the remaining one of the pair of straight-through track supports and the acutely angled track support, the vehicle launcher rapidly launching a succession of vehicles as the striker shuttle is drawn and released to create, or attempt to avoid, collision at the intersection.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
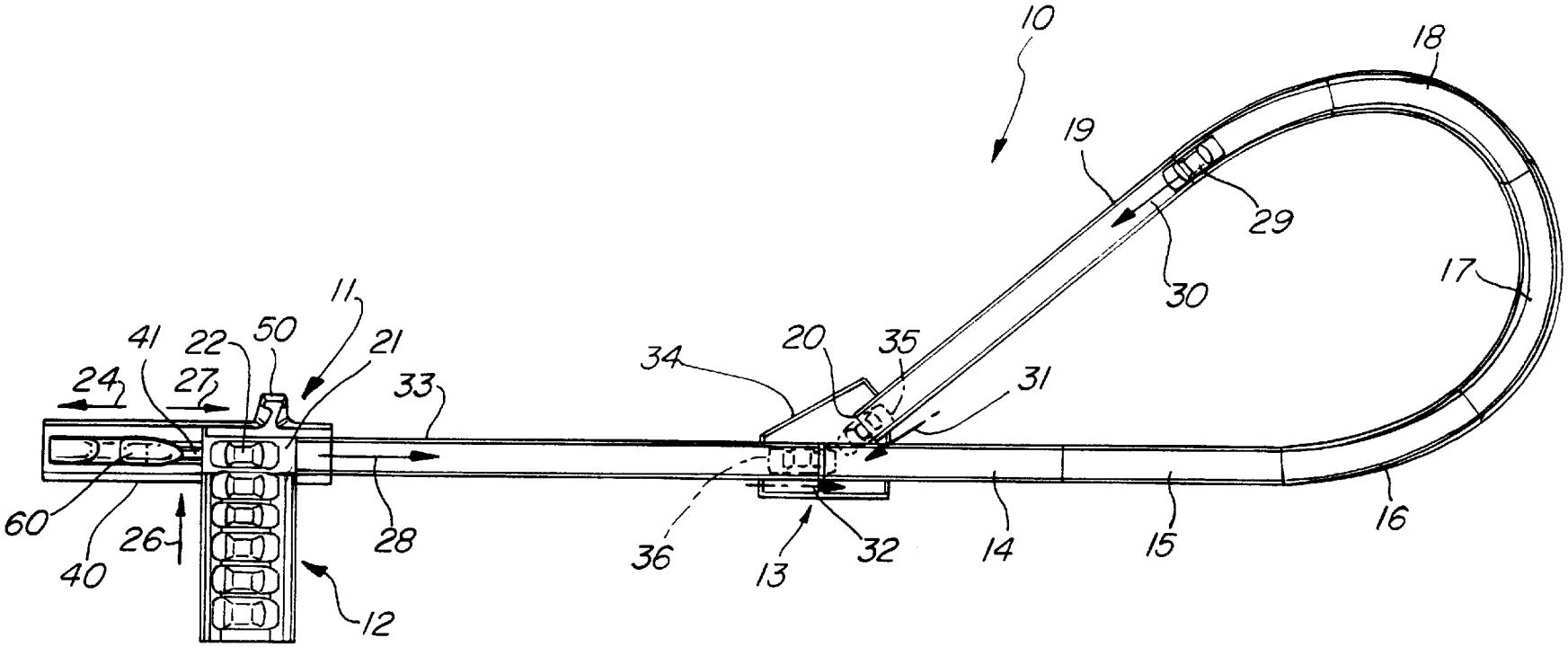
FIG. 1 sets forth a top plan view of a toy vehicle trackset constructed in accordance with the present invention.
Figure 2:
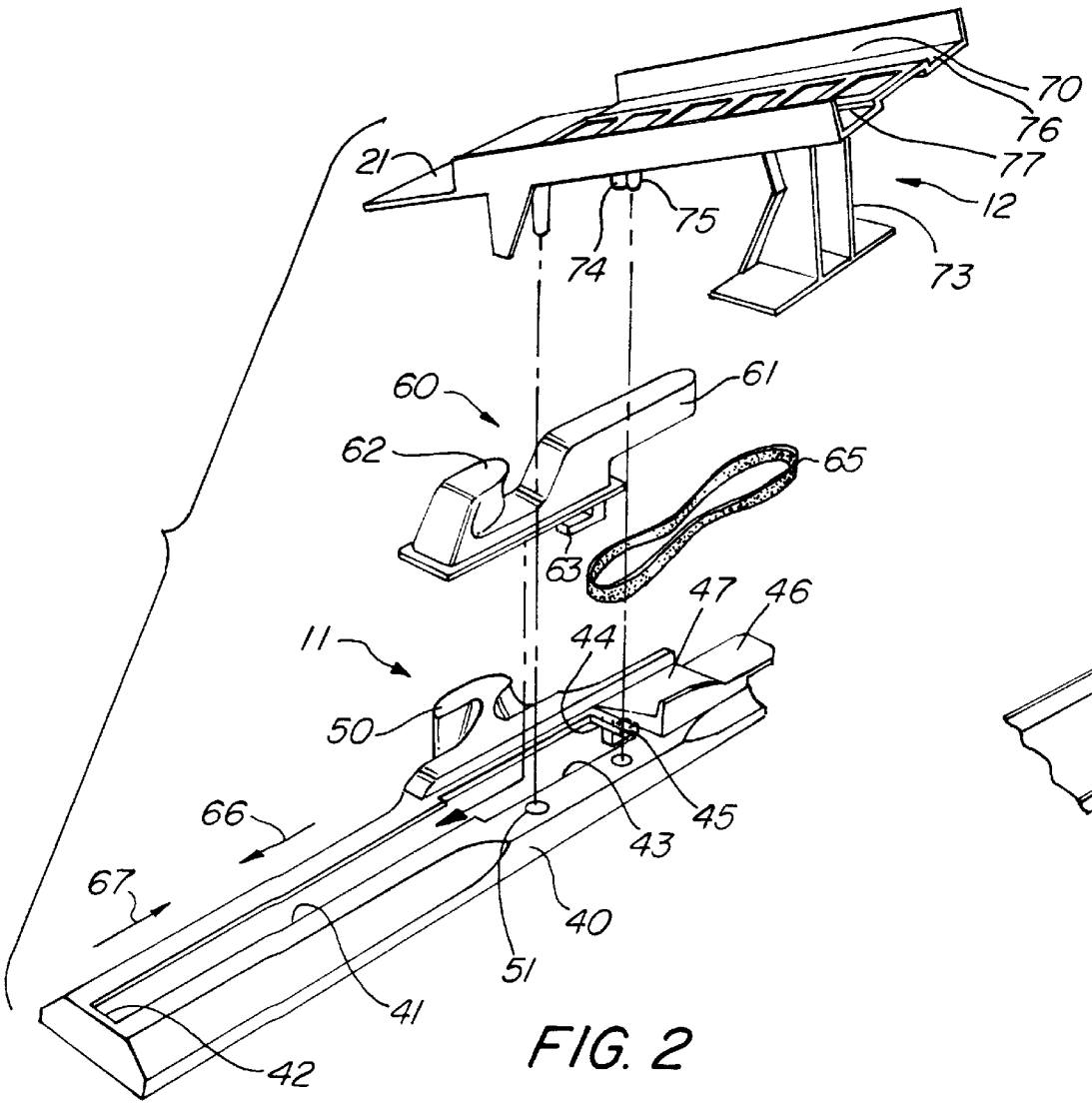
FIG. 2 sets forth a perspective assembly view of the rapid fire launcher of the present invention.

FIG. 1 sets forth a top plan view of a toy vehicle trackset having rapid fire launcher constructed in accordance with the present invention and generally referenced by numeral 10. Trackset 10 includes a launcher 11 having a magazine 12 supporting a plurality of toy vehicles which as is better seen in FIG. 2 provides a downwardly inclined ramp for sequentially urging toy vehicles downwardly. Launcher 11 defines a base 40 having a launch position 21 and a handle grip 50 formed therein. As is set forth below, vehicle magazine 12 is downwardly inclined toward launcher 11 and is secured thereto in the manner shown in FIG. 2. Suffice it to say here that in the absence of a vehicle at launch position 21, the gravitational force upon toy vehicles in vehicle magazine 12 slides the next sequential toy vehicle in the magazine downwardly to launch position 21. The structure of launcher 11 is set forth below in FIG. 2 in greater detail. However, suffice it to note here that launcher 11 includes a guide slot 41 within which a striker shuttle 60 is slidably supported. Striker shuttle 60 is coupled to a resilient elastic band spring which urges striker shuttle 60 forwardly. As is also set forth below in greater detail, launcher 11 is further coupled to a launcher track segment 33 which is aligned at one end with launch position 21.

Toy vehicle trackset 10 further includes an intersection 13 having a base 34. Base 34 is shown in greater detail in FIG. 3. However, suffice it to note here that intersection 13 is coupled to the output end of launcher track segment 33 and is further coupled to a track segment 14 to provide a straight through vehicle path. Additional track segments 15, 16, 17, 18 and 19 provide a curved path which returns to intersection 13 at an acute angle. Track segment 19 defines an end 20 which, as is set forth below in FIG. 3 in greater detail, is secured to base 34 of intersection 13. As is set forth below in greater detail, end 20 of track segment 19 is secured to a raised track support 90 which allows toy vehicles traveling through segment 19 to traverse the sidewalls of track segments 33 and 14 making the toy vehicle capable of crashing into another toy vehicle within intersection 13 as depicted by dashed-line toy vehicles 35 and 36.

In operation, a supply of toy vehicles is loaded upon vehicle magazine 12 in the manner shown. The bottommost toy vehicle occupies launch position 21 due to the sliding movement upon vehicle magazine 12. Striker shuttle 60 is drawn rearwardly in the direction indicated by arrow 24 against the force of spring 65. With striker shuttle 60 fully drawn, the release of striker shuttle 60 causes it to accelerate forwardly through guide slot 41 in the direction indicated by arrow 27 and strike the rear end of toy vehicle 22. The striker energy is transferred to toy vehicle 22 and, as a result, vehicle 22 is rapidly accelerated in the direction indicated by arrow 28 toward intersection 13.

In the absence of a colliding vehicle at intersection 13, toy vehicle 22 continues through intersection 13 as indicated by arrow 32 and thereafter traverses the curved portion of the trackway and turns toward intersection 13 via trackway segment 19 as indicated by toy vehicle 29 traveling in the direction indicated by arrow 30. It will be recalled that the portion of trackway 19 approximate to end 20 is raised sufficiently to allow toy vehicle 29 to pass over the sidewalls of track segments 33 and 14.

In accordance with the anticipated play pattern of the present invention game, however, the user operates launcher 11 in a rapid fire mode by repeatedly and quickly pulling and releasing striker shuttle 60 to sequentially launch a series of toy vehicles which migrate downwardly upon vehicle magazine 12 and are positioned in sequence at launch position 21. The result is a plurality of toy vehicles moving downwardly through intersection 13 and returning thereto for potential collisions. In an alternate but somewhat similar toy vehicle play pattern, the object may be exercised in which striker shuttle 60 is operated to launch a first vehicle and thereafter operated to launch a second vehicle in which the object is to achieve the collision impact positions shown for toy vehicles 35 and 36. Thus, the game takes on a test of skill and timing in firing the first toy vehicle which is used as a moving target and attempting to time the launch of the next toy vehicle to cause or avoid collision depending on the game being played.

FIG. 2 sets forth a perspective assembly view of toy vehicle launcher 11. As mentioned above, launcher 11 includes a base 40 having a handle grip 50 which is secured to a magazine 12. Base 40 defines an elongated guide slot 41 terminating in a closed end 42. Guide slot 41 terminates in a forward end 44. Base 40 further defines a spring grip 45 positioned beneath forward end 44 of guide slot 41. Base 40 further defines a transition ramp 47 and a tongue 46. The latter is generally planar and of correct size and width to engage a standard toy vehicle track of the type shown in FIG. 3.

A striker shuttle 60 defines a handle 62 and a ram 61. Striker shuttle 60 further defines a spring grip 63. Shuttle 60 is assembled to base 40 by dropping shuttle 60 into opening 43 of guide slot 41 and thereafter sliding shuttle 60 rearwardly in the direction indicated by arrow 66. At a convenient point in the assembly and preferably from beneath base 40, a spring 65 which is preferably fabricated of a resilient elastic material such as rubber or the like is secured between spring grip 45 of base 40 and spring grip 63 of striker shuttle 60. It will be recognized by those skilled in the art that while the preferred embodiment of the present invention employs a resilient rubber spring, other types of springs may be used without departing from the spirit and scope of the present invention such as conventional coil springs or the like.

Base 40 further defines a pair of apertures 51 and 52. Correspondingly, magazine 12 includes an inclined magazine ramp 70 having a pair of downwardly extending posts 74 and 75 which are received within apertures 51 and 52 respectively. Magazine ramp 70 further supports a launch position platform 21, angled such that the attachment of magazine ramp 70 to base 40 aligns launch position platform 21 to cover opening 43 and generally align with transition ramp 47. Additional support for magazine ramp 70 is provided by a pair of legs 71 and 72 together with a rear support 73. In accordance with the preferred fabrication of the present invention, magazine ramp 70 defines alignment channels 76 and 77 which receive the front and rear wheels respectively of toy vehicles supported upon magazine ramp 70. The use of aligned channels 76 and 77 operates to guide sequential toy vehicles downwardly to launch position 21 as each succeeding vehicle is launched.

Thus, with launcher 11 assembled, the user grips handle grip 50 and repeatedly draws striker shuttle 60 rearwardly to closed end 42 and thereafter releases striker shuttle 60 accelerating striker shuttle 60 in the direction indicated by arrow 67 using the stored energy within spring 65 to impact the toy vehicle positioned at launch position 21 using ram 61. In accordance with an important aspect of the present invention, this operation may be carried forward at a very high rate in which the user is able to launch vehicles as fast as the user can draw and release striker shuttle 60. The feed rate of ramp 70 to launch position 21 is sufficiently fast to meet this rapid fire operation.

Figure 3:
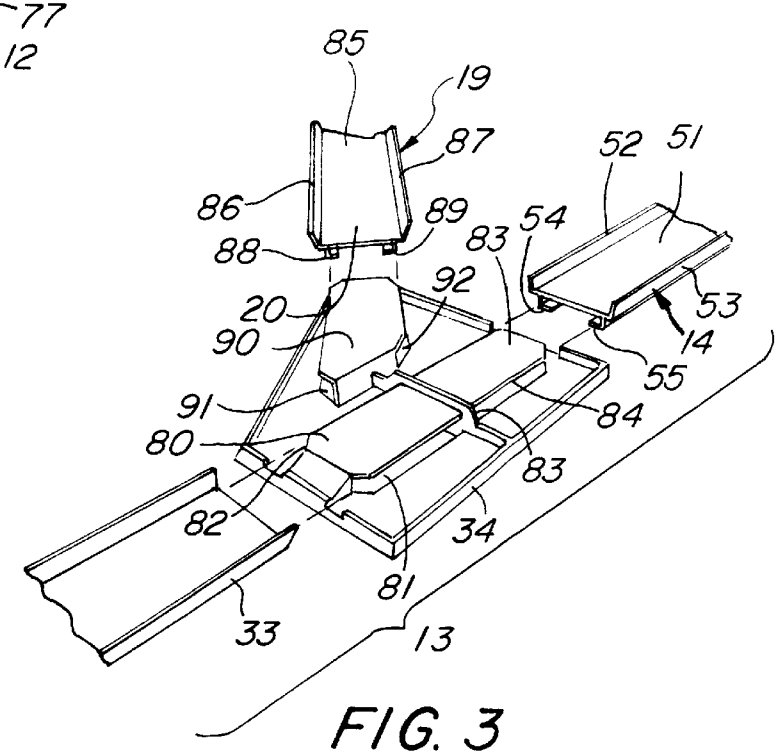
FIG. 3 sets forth a perspective view of the track intersection of the present invention vehicle trackset showing portions of trackway assembleable thereto.

FIG. 3 sets forth a perspective assembly view of intersection 13 and cooperating track segment ends. It will be recalled from the discussions in FIG. 1 that the basic function of intersection 13 is to provide a straight-through path for vehicles launched by launcher 11 (seen in FIG. 1) and to provide a potentially colliding return path at an acute angle creating the possibility of collision between successive cars traversing intersection 13 and returning thereto. More specifically, intersection 13 includes a base 34 having a track support 80 which in turn defines a pair of side channels 81 and 82. Base 34 further includes a partition 83 traversing track support 80 and a track support 83 which in the preferred embodiment of the present invention is generally aligned with track support 80. Track support 83 defines a channel 84 on one side and a corresponding channel (not shown) on the opposite side thereof.

Intersection 13 further includes a track support 90 angularly positioned upon base 34 to define an acute angle of intersection between straight-through track supports 80 and 83. Thus, track support 90 includes a pair of channels 91 and 92 extending the length thereof. A track segment 19 defines a track path 85 and sidewalls 86 and 87. In accordance with conventional fabrication techniques, sidewalls 86 and 87 operate to guide a toy vehicle down trackway path 85. Track segments 19 defines an end 20. In accordance with conventional fabrication techniques, track segment 19 defines a pair of inwardly extending slide elements 88 and 89 which are supported upon the underside of track segment 19 and spaced to allow slide elements 88 and 89 to enter channels 91 and 92 as end 20 is assembled to track support 90. Once again, it should be recalled that track support 90 is raised with respect to track supports 80 and 83 to position end 20 above the sidewalls of track segments 33 and 14.

In a similar fashion, track segment 14 defines a track pathway 51, sidewalls 52 and 53 and slide elements 54 and 55. Thus, track pathway 51 is assembled to track support 83 in the same manner as described above in which trackway path 15 is placed upon track support 33 and slid forwardly to engage slide elements 54 and 55 into the channels of track support 83. By further similarity, the end portion of track segment 33 is assembled to track support 80 such that the slide elements (not shown) on the underside of track segment 33 are received within channels 81 and 82.

Thus, with track segments 33 and 14 assembled to intersection 13 against partition 83, an uninterrupted straight-through path for intersection 13 is established. Additionally, end 20 of track segment 19 being raised a sufficient height to clear the proximate sidewalls of track segments 33 and 14 directs track path 85 to intersection 13 in a potentially collision producing relationship. This allows the above-described game play patterns in which the operator is challenged to either attempt to cause such collisions or, alternatively, to move toy vehicles down the trackway without causing such collisions. In either event, the simultaneous travel of two vehicles through intersection 13 will result in a dramatic collision event of the toy vehicles.

What has been shown is an improved toy vehicle trackset having a rapid fire launcher and a collision producing intersection which allows the user to launch toy vehicles from the launcher in a rapid fire action and deal with the collision potential at the intersection. The entire apparatus may be fabricated of conventional molded plastic parts suitable for high volume, low cost manufacture and is safe in operation for the child user.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle trackset and plurality of toy vehicles in combination comprising:

a plurality of toy vehicles;

a vehicle launcher having a base, a static launcher station, a striker shuttle slidably movable upon said base in a launch direction, a spring coupled between said striker shuttle and said base, a toy vehicle magazine having a ramp angled downwardly toward said launch station for receiving said plurality of toy vehicles each generally aligned with said launch direction in a side-by-side relationship;

an intersection having a pair of straight-through track supports and an acutely angled track support;

a first track segment coupled between said base and one of said straight-through track supports;

a second track segment coupled between the remaining one of said pair of straight-through track supports and said acutely angled track support, said vehicle launcher rapidly launching a succession of said vehicles as said striker shuttle is drawn and released and as said magazine feeds said toy vehicles to said launch station in a sideways movement to create, or attempt to avoid, collision at said intersection.

2. The combination set forth in claim 1 wherein said acutely angled track support is raised relative to said pair of straight-through track supports.

3. The combination set forth in claim 2 wherein said launch station is angled and supports a to-be-launched toy vehicle angled from the horizontal.

4. The combination set forth in claim 3 wherein said first track segment is substantially horizontal and wherein said base includes a transition ramp coupled between said launch station and said first track segment and defining a transition surface which rotates a launched vehicle into alignment with said first track segment.

5. The combination set forth in claim 4 wherein said second track segment includes a return curve.

6. The combination set forth in claim 1 wherein said second track segment includes a return curve.

* * * * *